US006112139A

United States Patent [19]

Schubert et al.

[11] Patent Number: 6,112,139

[45] Date of Patent: Aug. 29, 2000

[54] APPARATUS AND METHOD FOR WIRELESS REMOTE CONTROL OF AN OPERATION OF A WORK VEHICLE

[75] Inventors: William L. Schubert, Downers Grove; Abraham Orbach, Naperville, both of Ill.

[73] Assignee: Case Corporation, Racine, Wis.

[21] Appl. No.: 09/182,149

[22] Filed: Oct. 29, 1998

[51] Int. Cl.[7] ..... G05D 1/00; G05D 3/00; G06F 7/00

[52] U.S. Cl. ..... 701/2; 701/1; 701/50; 172/9; 172/4.5

[58] Field of Search ..... 701/1, 2, 49, 50; 172/2, 4.5, 9; 37/347, 348; 455/151.2, 152.1, 351, 352

[56] References Cited

U.S. PATENT DOCUMENTS 4,918,608 4/1990 Middleton et al. ..... 701/50
5,327,345 7/1994 Nielsen et al. ..... 701/50
5,650,928 7/1997 Hagenbuch ..... 701/50

*Primary Examiner*—William A. Cuchlinski, Jr.
*Assistant Examiner*—Gertrude Arthur
*Attorney, Agent, or Firm*—Foley & Lardner

[57] ABSTRACT

An apparatus and method is disclosed for wireless remote control of an output element coupled to a work vehicle. The output element performs work external to the vehicle and is actuated by an actuator controlled by an output controller in response to at least a remote control signal. The apparatus includes a wireless remote transmitter movable with respect to the vehicle and a wireless receiver supported by the vehicle. The transmitter has an actuatable input device for generating a command signal, a transmitter antenna, and a transmitter control circuit which receives the command signal from the input device, generates the remote control signal in response to the command signal, and applies the remote control signal to the transmitter antenna for wireless transmission to the work vehicle. The receiver includes a receiver antenna and a receiver control circuit which receives the remote control signal from the receiver antenna after transmission by the transmitter, and applies the remote control signal to the output controller.

33 Claims, 8 Drawing Sheets

320
HI-SPEED DIGITAL PORTS
DIGITAL PORTS
306
320a
320b
310
TIMER
ANALOG PORTS
MICROPROCESSOR
MEMORY
304
302
DATABUS PORT
ELECTRONIC CONTROL UNIT
330
301
160-164
COMMUNICATIONS DATABUS

APPARATUS AND METHOD FOR WIRELESS REMOTE CONTROL OF AN OPERATION OF A WORK VEHICLE

FIELD OF THE INVENTION

The present invention relates to an apparatus and a method for wireless remote control of an output element coupled to a work vehicle. The present invention further relates to an apparatus and a method for wireless remote control of an output element coupled to a work vehicle wherein remote activation of the output element is enabled only when commanded from within a certain spatial region or zone relative to the work vehicle.

BACKGROUND OF THE INVENTION

Work vehicles (including agricultural work vehicles such as tractors and combines and construction vehicles such as loader-backhoes) include a variety of output elements that perform actions on the environment around the vehicle. For example, a tractor typically includes a hitch which can be coupled to an implement such as a planter, sprayer, air drill, conventional drill, disk harrow or chisel plow. The tractor may be required to raise or lower the implement by raising or lowering the hitch to which the implement is attached, or may be required to provide power to the implement by way of a power-take-off ("PTO") shaft or by controlling the flow of hydraulic fluid through auxiliary valves.

An operator typically controls such output elements using control levers, buttons or other input devices mounted in the cab of the work vehicle. Such input devices may be located within a small physical area (or even combined onto a single input system) for easy access by the operator. Location of these input devices within the cab is necessary since many controls must be accessible by an operator when the work vehicle is moving. For example, the operator must have the ability to raise and lower the hitch of the tractor, and thus the implement, from within the cab as a tractor is moving.

There are also circumstances under which it would be appropriate to allow the operator to control an output element from a position outside of the cab when the work vehicle is stationary. For example, an operator may need to move the hitch while coupling and uncoupling an implement thereto. For another example, the operator may wish to raise the position of the hitch, and thus the implement attached thereto) to examine the underside of the implement or to retract the implement out of crops or other obstructions in which the implement has become tangled. Allowing an operator to control output elements while outside the cab (in addition to while within the cab) provides greater convenience and flexibility. In certain circumstances, control while outside the work vehicle cab may be necessary insofar as the operator may not be able to obtain a satisfactory view of a controlled output element while remaining within the cab.

Output elements may be controlled by an operator while outside of a work vehicle cab by way of control levers, buttons or other input devices located at fixed positions on the vehicle outside of the cab. For example, the hitch on a tractor may be raised and lowered using hitch raise or lower buttons located on the rear fender of the tractor. Satisfactory locations for such input devices on a work vehicle are, however, not always available outside the cab. For example, buttons located on the rear fender may be impractical for an operator if the tractor becomes so large (particularly due to large wheels) that the fender is located high off the ground. Further, input devices located outside the cab may be susceptible to inadvertent actuation (e.g., by a passing branch) and damage from environmental elements (e.g., weather conditions), may be ergonomically difficult to engineer, or may be aesthetically unappealing.

Accordingly, it would be advantageous to have a system for allowing an operator of a work vehicle to control the functioning of an output element of the work vehicle while the operator is located outside the work vehicle's cab (in addition to inside the cab). It would also be advantageous if the system was a wireless remote control system which allows the operator to control the output elements from within a range of positions outside the cab, as opposed to only specific, fixed positions.

It would be advantageous to have a wireless remote control system having certain operator positions within the range of positions from which control of the output elements is allowed, wherein such positions are positions at which the operator can view the controlled output elements. It would further be advantageous to have a wireless remote control system that excludes certain operator positions from the range of positions from which control of the output elements is allowed.

It would also be advantageous to have a wireless remote control system that utilizes standard and (relatively) inexpensive components. It would further be advantageous to have a wireless remote control system having a compact transmitter allowing for easy transport of the input devices by the operator.

SUMMARY OF THE INVENTION

One embodiment of the invention relates to an apparatus for wireless remote control of an output element coupled to a work vehicle. The output element performs work external to the vehicle and is actuated by an actuator controlled by an output controller in response to at least a remote control signal. The apparatus includes a wireless remote transmitter movable with respect to the work vehicle, and a wireless receiver supported by the work vehicle. The transmitter includes an actuatable input device for generating a command signal, a transmitter antenna and a transmitter control circuit which receives the command signal from the input device, generates the remote control signal in response to the command signal, and applies the remote control signal to the transmitter antenna for wireless transmission to the work vehicle. The wireless receiver includes a receiver antenna and a receiver control circuit which receives the remote control signal from the receiver antenna after transmission by the wireless remote transmitter and applies the remote control signal to the output controller, wherein the output element is responsive to actuations of the input device.

Another embodiment of the invention relates to a method of wireless remote control of an output element coupled to a work vehicle. The output element performs work external to the vehicle and is actuated by an actuator controlled by an output controller in response to at least a remote control signal. The method includes locating a wireless remote transmitter movable within a particular spatial region relative to the vehicle, providing a command signal to a transmitter control circuit of the wireless remote transmitter using an actuatable input device, generating a remote control signal at the transmitter control circuit in response to the command signal, and sending the remote control signal to a wireless receiver supported by the vehicle using a transmitter antenna. The method also includes receiving the remote control signal at a receiver control circuit of the wireless receiver using a receiver antenna, and applying the remote control signal to the output controller, wherein the output element is responsive to actuations of the input device.

DETAILED DESCRIPTION OF THE INVENTION

Figure 1:
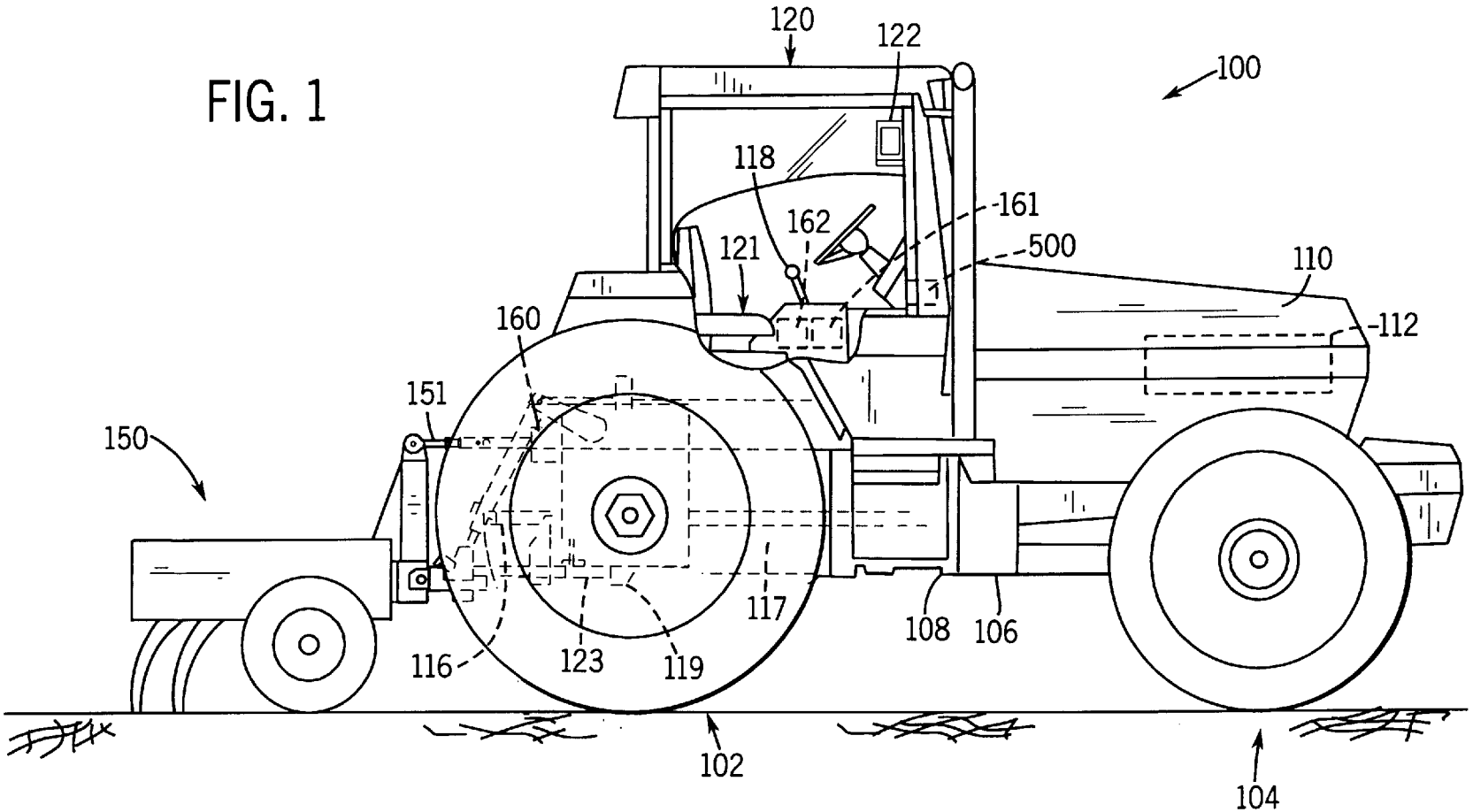
FIG. 1 is a side elevational view of an agricultural work vehicle (e.g., a tractor) towing an implement.

Turning now to FIG. 1, a tractor 100 is shown, representative of agricultural work vehicles such as the Case Corp. MX MAGNUM tractor. Tractor 100 has rear wheels 102, front wheels 104, a tractor frame 106 and a chassis 108. Tractor 100 also has an engine compartment 110 containing an engine or power plant 112 that powers various drive train elements such as a power-take-off ("PTO") shaft 116 via a transmission 117 and a hydraulic system (not shown). Tractor 100 further has an operator cab 120, provided with a variety of instruments and input devices. Among these instruments and input devices are operator interfaces shown as an armrest control console 121, which supports many input devices (e.g., switches, levers, knobs), and a touch-sensitive video monitor or "touch screen" 122 capable of obtaining input signals from the operator and displaying visual information to the operator. Also provided in cab 120 is an auxiliary controller 118 for controlling elements of the hydraulic system such as one or more auxiliary valves 119.

PTO shaft 116 and auxiliary valves 119 are exemplary controllable output devices. PTO shaft 116 is controlled between an "on" state, in which the PTO shaft rotates, and an "off" state, in which the PTO shaft does not rotate. Auxiliary valves 119 each have four states, raise, lower, float and neutral. When in the raise state, an auxiliary valve allows pressurized hydraulic fluid to flow into one outlet port and out of a second outlet port (not shown), while in the lower state, that auxiliary valve allows the fluid to flow out of the first outlet port and into the second outlet port. When in the float state, the auxiliary valve allows fluid to flow into both of the outlet ports towards the source of the hydraulic fluid, while in the neutral state, the auxiliary valve prevents all fluid flow through either of the outlet ports.

Tractor 100 includes a three-point hitch 151 that may be coupled to an implement, shown in FIG. 1 as a chisel plow 150 (such as a Case Corp. 5800 Multi-Till Chisel Plow). In other embodiments, tractor 100 may instead tow one of a variety of other implements used to perform functions on a field, including planters, sprayers, air drills, conventional drills, disk harrows and rippers, such as the Case Corp. 955 Early Riser Cyclo Air planter, 3000 TS Sprayer, 3503 Air Drill, 5500 Conventional Drill, 3950 Tandem Disk Harrow and 6810 Ripper, respectively (not shown). Some of these implements may include hydraulic system elements connected using hydraulic lines (e.g., hydraulic lines 123) to tractor 100 and thereby may receive hydraulic power from tractor 100, the delivery of which may be controlled by auxiliary valves 119.

Along with PTO shaft 116 and auxiliary valves 119, hitch 151 is another exemplary controllable output element. Hitch 151 may be directed to raise or to lower. Raising and lowering of hitch 151 causes, in the case of a small, hitch-mounted implement (such as chisel plow 150), the entire implement to raise or lower with the hitch or, in the case of a large implement, a portion of the implement to raise or lower with respect to ground.

Tractor 100 further includes electronic control units 160–162 which are controlled (at least in part) by the operator via the operator controls located within cab 120, such as armrest control console 121 or touch screen 122. In particular, tractor 100 includes a hitch control unit 160, an auxiliary valve control unit 161, and a PTO shaft control unit 162 for controlling, respectively, the position of hitch 151, the states of auxiliary valves 119 (e.g., raise or lower), and the status of PTO shaft 116 (e.g., on or off). In other embodiments, only certain of control units 160–162 are employed or other control units are employed for controlling additional controlled output elements. Control units 160–162 are connected to and control electromechanical actuators (not shown) for actuating the respective output elements. Typically, these actuators include solenoids that cause hydraulic valves to open or close, and thereby convert electrical control signals from the control units into mechanical (hydraulic) energy for actuating the output elements. Electronic control units 160–162 may be interconnected with one another or with other elements by way of an electronic communications databus 301 (see FIG. 3). However, such interconnections need not be via databus 301 and, in alternate embodiments, electronic control units 160–162 may be interconnected with one another or with other elements by way of hardwiring.

Figure 2:
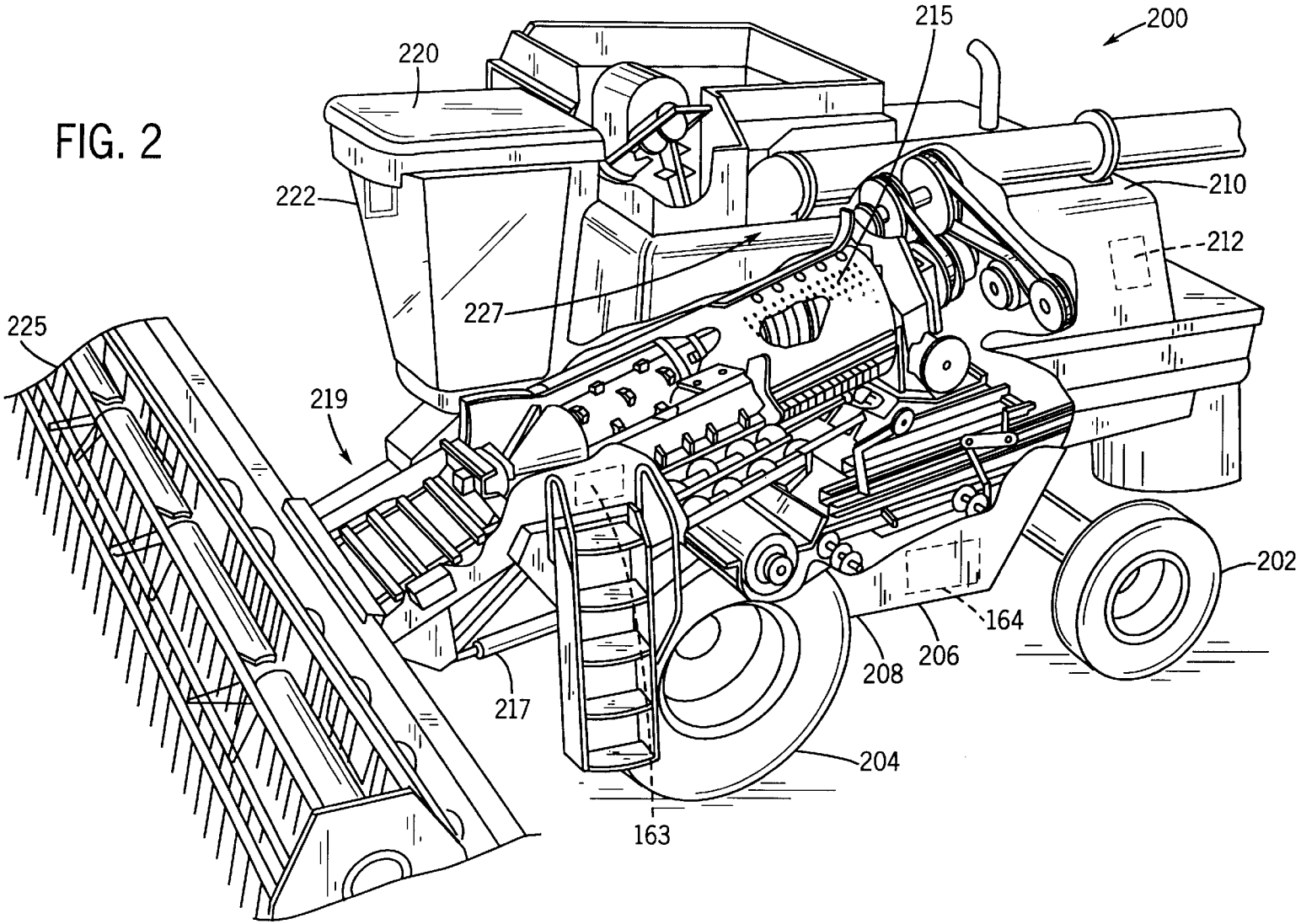
FIG. 2 is a side perspective view of a second agricultural work vehicle (e.g., a combine)

In FIG. 2, a combine 200 is representative of agricultural work vehicles such as the Case Corp. 2188 AFS Combine. Combine 200 has rear wheels 202, front wheels 204, a frame 206 and a chassis 208. Combine 200 also has an engine compartment 210 containing an engine or power plant 212 that powers various drive train elements (not shown) and processing elements 215, which act upon harvested crops. Combine 200 has an operator cab 220 provided with a variety of instruments and input devices. Among these instruments and input devices is an operator interface such as a touch-sensitive video monitor or "touch screen" 222 capable of obtaining input signals from the operator and displaying visual data to the operator. Another operator interface that may be used (not shown) is an armrest control console analogous to armrest control console 121 of tractor 100. Combine 200 includes a header 225 for harvesting crops. Header 225 may be raised or lowered depending upon the height of the crops and the height of obstructions on the ground that should be avoided (e.g., to prevent damage to the header). Also, combine 200 includes a conveyor 227 for delivering crops to a storage bin (not shown). Header 225 and conveyor 227 are exemplary controllable output elements. Header 225 may be raised or lowered by way of a header lift mechanism including hydraulic cylinders 217 (only one shown in FIG. 2), while conveyor 227 may be controlled between an "on" state, in which the conveyor delivers crops to the storage bin, and an "off" state.

Header 225 can be moved while combine 200 is stationary. For example, header 225 may be raised or lowered to align a lubrication fitting to facilitate lubrication. The system may also allow for control of one or more header drive mechanisms such as mechanism 219 while combine 200 is stationary.

Combine 200 also includes electronic control units 163–164. In particular, combine 200 includes a combine header control unit 163 and a conveyor control unit 164 for controlling, respectively, the position of header 225 and the status of conveyor 227 (e.g., on or off). In alternate embodiments, only certain of control units 163–164 may be present, or additional control units may be used to control additional output elements. As with respect to tractor 100, control units 163–164 are connected to and control electromechanical actuators (not shown) for actuating the respective output elements. The actuators are, typically, solenoids that cause hydraulic valves to open or close, and thereby convert electrical control signals from the control units into mechanical (hydraulic) energy for actuating the output elements. Electronic control units 163–164 may be interconnected with one another or with other elements by way of an electronic communications databus 301 (see FIG. 3). However, such interconnections need not be via databus 301 and, in alternate embodiments, electronic control units 163–164 may be interconnected with one another or with other elements by way of hardwiring.

Figure 3:
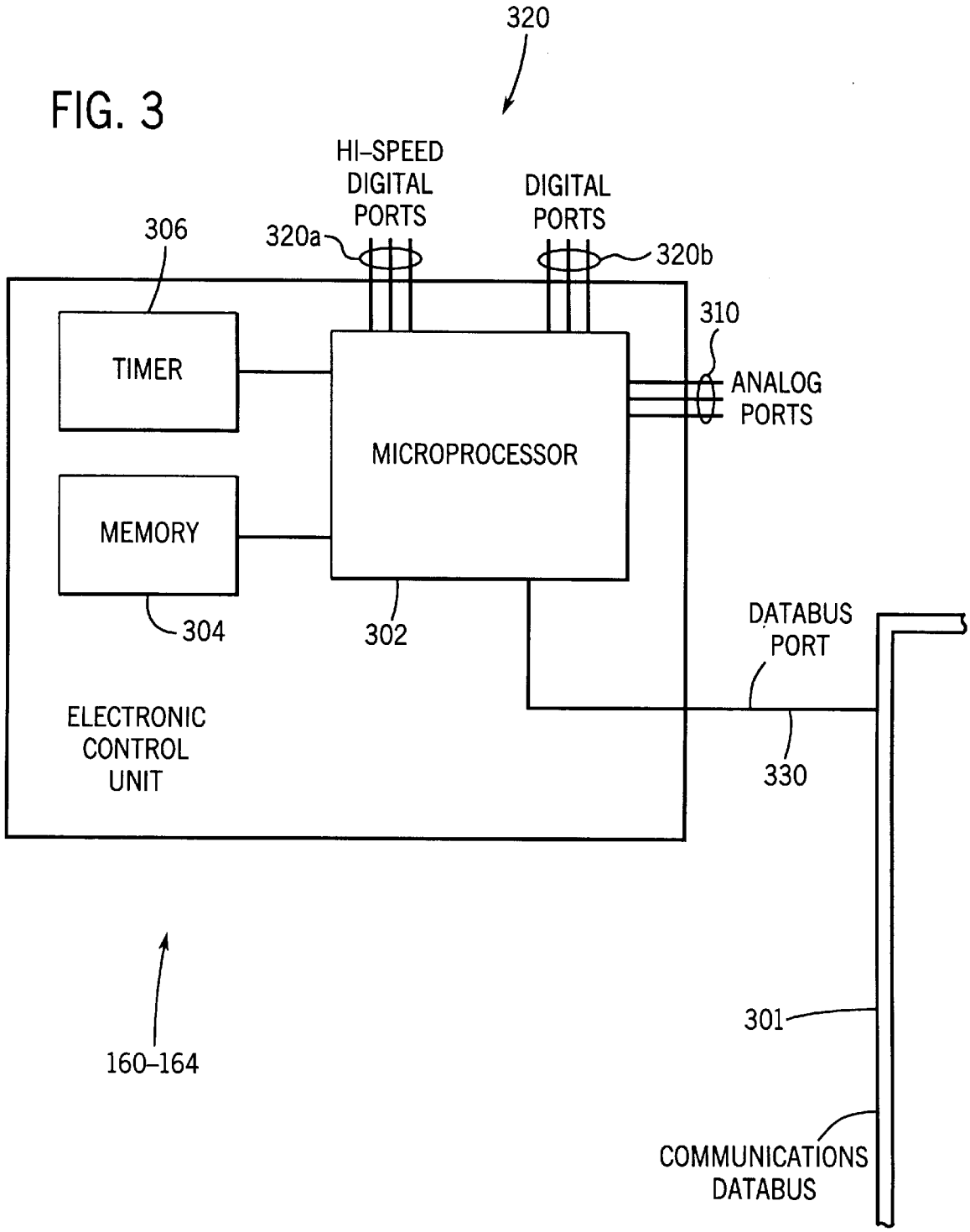
FIG. 3 is a block diagram showing internal elements of an electronic control unit connected to a communications databus.

As shown in FIG. 3, electronic control units 160–164 have some common internal components including a processing device such as microprocessor 302 and a memory 304. Additionally, units 160–164 are "programmable" with control programs and/or information stored in the form of configuration tables (not shown) in memory 304. Such control programs and tables are used by units 160–164 to determine various parameters such as timing delays. Microprocessor 302 includes one or more analog input-output ports 310 and digital input-output ports 320, such as high-speed digital ports 320*a* and standard digital ports 320*b*, for receiving and transmitting information. Furthermore, microprocessor 302 may include one or more databus ports 330. (As mentioned above, electronic control units 160–164 may, but need not, be interconnected via databus 301.) Electronic control units 160–164 may also include a timer 306, which may exist (as depicted) as a separate circuit element of each electronic control unit in communication with microprocessor 302 or as a part of the microprocessor (e.g., a subroutine). Also, according to alternative embodiments, control units 160–164 may differ in structure from the above (or from each other). For example, one or more of units 160–164 may be implemented using dedicated, hardwired logic circuits.

Figure 4:
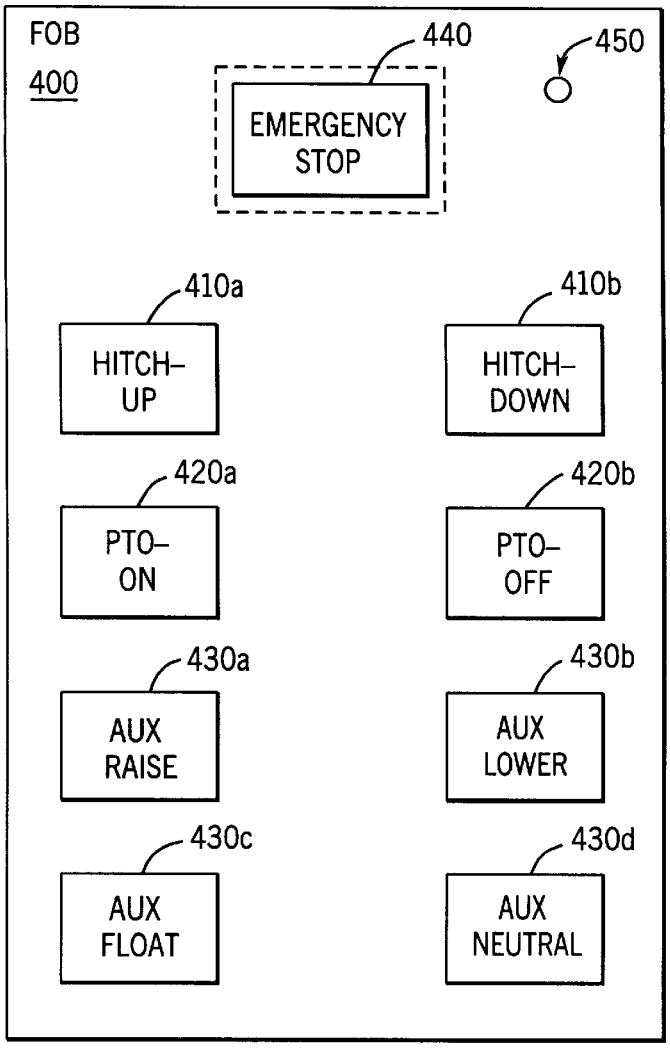
FIG. 4 is a top plan view of a fob with multiple push-buttons.
Figure 5:
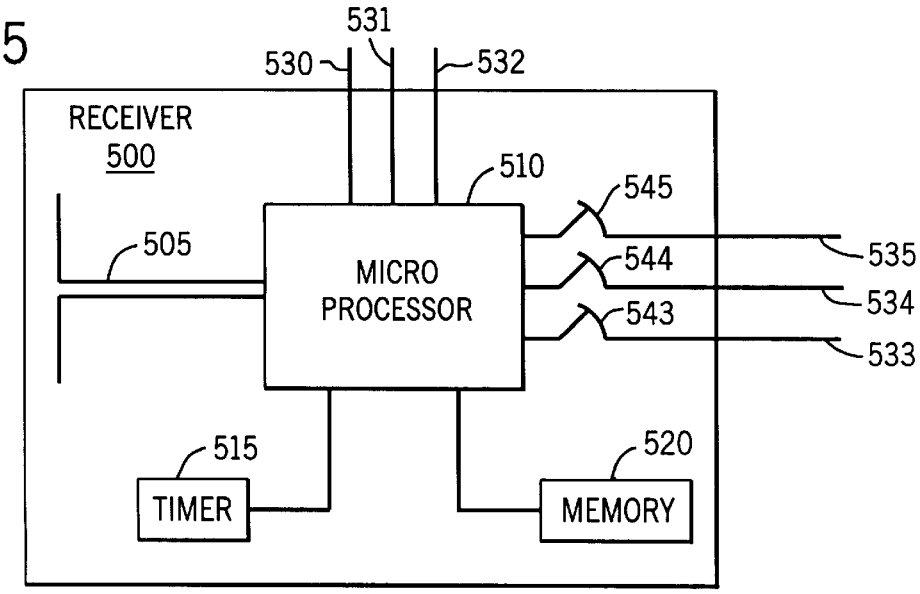
FIG. 5 is a block diagram showing internal elements of a receiver.
Figure 8:
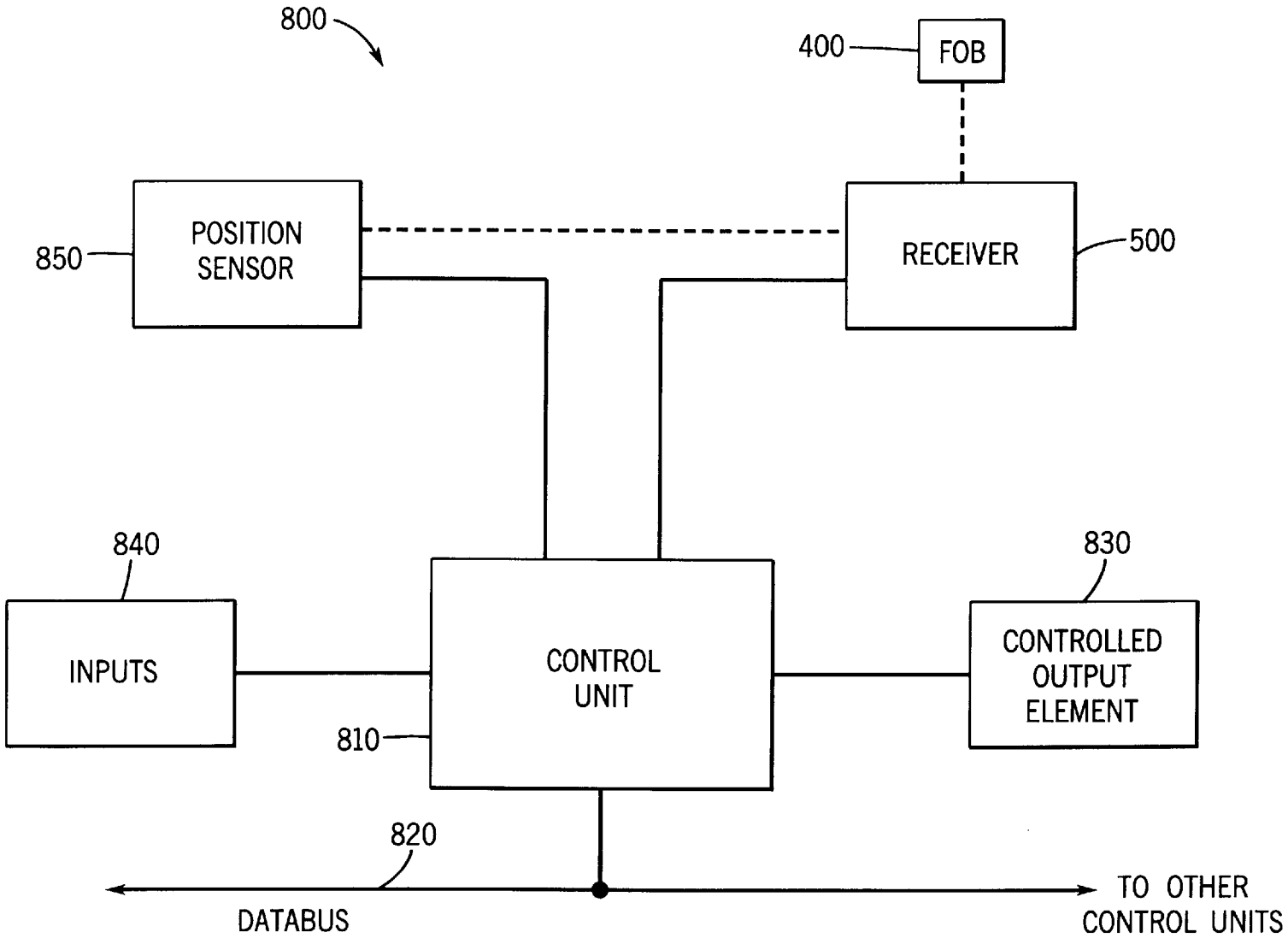
FIG. 8 is a block diagram showing the elements of an exemplary control system for the agricultural work vehicles of FIGS. 1 and 2.
Figure 9:
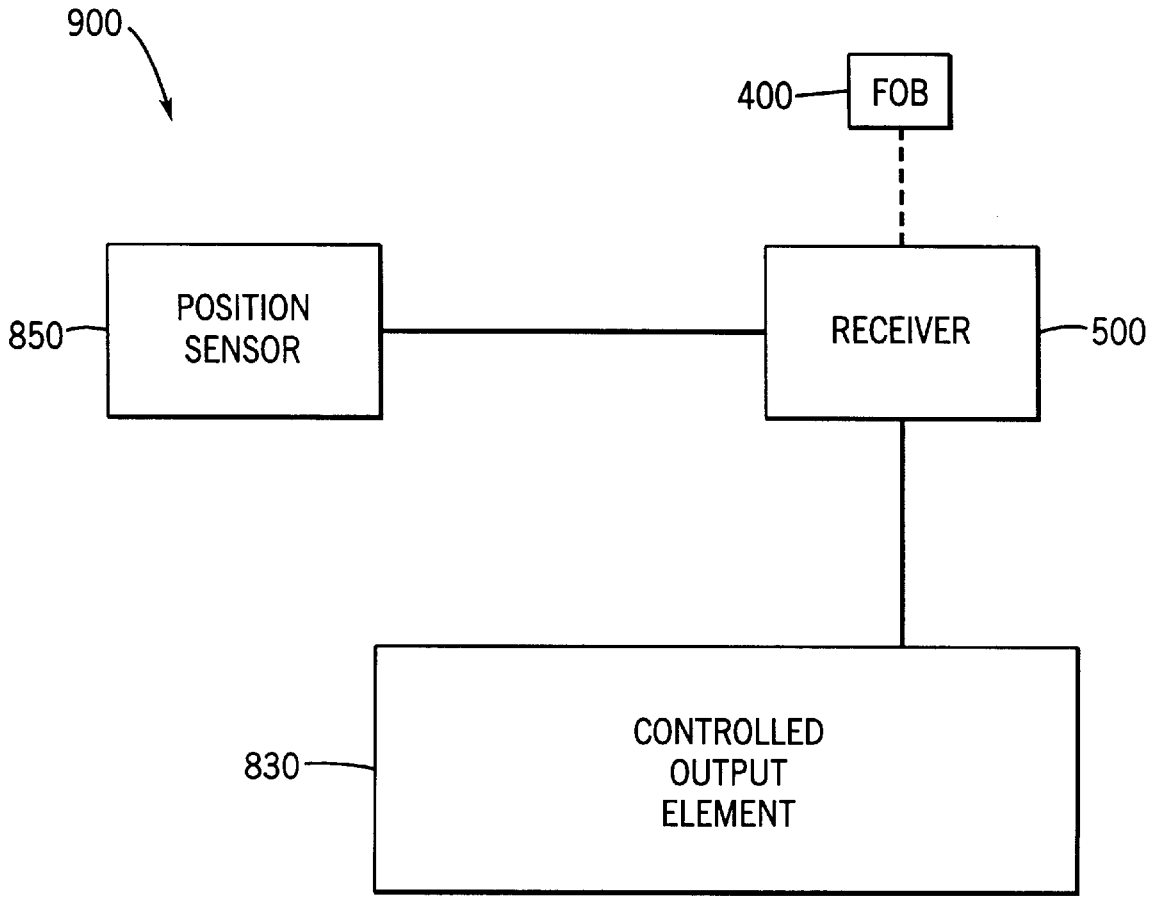
FIG. 9 is a block diagram showing an alternate exemplary control system for the vehicles of FIGS. 1–2.

While the controlled output elements of tractor 100 (which may include, but need not be limited to, PTO shaft 116, auxiliary valves 119, and hitch 151) and combine 200 (which may include, but need not be limited to, header 225 and conveyor 227) may be controlled by the operator using armrest control console 121 or touch screen 122, or other input devices located in cab 120 or 220, the systems disclosed herein include a wireless remote control system, components of which are shown in FIGS. 4 and 5, configured for use with tractor 100. (The interrelation of these components to each other and to other elements of tractor 100 or to combine 200 is shown in FIGS. 8 and 9.)

Referring to FIG. 4, a wireless remote control transmitter or "fob" 400 is shown. Fob 400 is designed to be compact and handheld by the operator. At the same time, tractor 100 may have, within cab 120 or at other locations on the tractor, holders (or rests) for fob 400 (not shown). These holders serve as convenient places for the operator to leave fob 400 when the operator is not holding or carrying it, help to prevent loss of the fob, and may be designed to include sensors (not shown) wherein tractor 100 (or a controller in the tractor) can sense whether the fob is present in a particular holder. Such a sensor may be used to determine the location of the fob, and whether the fob has been misplaced.

The overall design and internal structure of fob 400 is similar to that of wireless remote control transmitters or fobs used in conjunction with automobiles to allow an operator to actuate the headlights, doorlocks or trunk-lock, and/or alarm from a remote location. More specifically, fob 400 is microprocessor-based and in one embodiment the fob transmits output (radio) signals at a frequency of 319 MHz, with pulsed AM (PPM) modulation (1 KHz@ 100% modulation). The antenna (not shown) in this embodiment is a circuit board trace/loop omnidirectional antenna. The transmitted output power of fob 400 in this embodiment is −55 dBm (nom) measured at five meters (from Calibrated Dipole) and is generated by a battery within the fob, such as a +3VDC/CR2025 Wafer Cell (not shown). These features of fob 400 are only exemplary and may vary significantly in alternate embodiments.

As shown in FIG. 4, fob 400 includes several operator input push-button switches 410–430 on the upper surface of the fob. In alternate embodiments, push-buttons 410–430 may be positioned on other, or multiple sides of fob 400 (which itself may have shapes other than the rectangular box in FIG. 4.). Also, in alternate embodiments, push-buttons 410–430 may be substituted with other types of operator input devices such as knobs (such as potentiometer knobs) or flip-switches. Push-buttons 410–430 allow the operator to provide input commands to fob 400, which transmits radio signals in response to such input commands via the antenna.

Push-buttons 410–430 include specific pushbuttons for the control of the controlled output elements (the particular push-buttons will depend, for example, upon whether the work vehicle is tractor 100 or combine 200). As shown, fob 400 is configured to be used with tractor 100, and consequently has pairs of hitch control push-buttons 410, PTO shaft control push-buttons 420, and auxiliary valve control push-buttons 430 for receiving input commands relating to hitch 151, PTO shaft 116 and auxiliary valves 119, respectively.

Hitch control push-buttons 410*a* and 410*b* are respectively labeled "hitch-up" and "hitch-down" to indicate to the operator that the former push-button causes the hitch to raise and the latter push-button causes the hitch to lower. Similarly, PTO shaft push-buttons 420*a* and 420*b* are respectively labeled "PTO on" and "PTO off" to indicate to the operator that the former push-button causes the PTO to rotate and the latter push-button causes the PTO to stop rotating. Also, auxiliary valve push-buttons 430*a–d* are labeled, respectively, "raise", "lower", "float" and "neutral" to indicate to the operator that the push-buttons respectively cause an auxiliary valve to enter the raise, lower, float or neutral states. In alternate embodiments, fob 400 may only include auxiliary valve push-buttons corresponding to certain of these states (e.g., raise and lower), or may include additional auxiliary push-buttons for controlling the states of additional auxiliary valves.

While fob 400 in FIG. 4 is shown configured for use with tractor 100, a similar fob with analogous push-buttons (related to control of header 225 and conveyor 227) would be appropriate for use with combine 200.

Push-buttons 410–430 may function in one of two ways. First, push-buttons 410–430 may be configured to operate as "deadman" switches. In this configuration, fob 400 would only transmit a particular control signal in response to the pressing of a push-button for as long as the operator physically held the push-button down. This configuration is especially appropriate where fine control of an output element is desirable. For example, with respect to controlling the raising and lowering of hitch 151, the operator typically would wish to control exactly how far the hitch is raised and lowered. This is only possible if hitch 151 stops raising and lowering immediately when the operator so specifies (i.e., when the operator releases the "hitch-up" or "hitch-down" button). Control of auxiliary valves 119 also likely would involve the use of deadman-type push-buttons.

Second, push-buttons 410–430 may operate as time-delay switches. In this configuration, fob 400 continues to transmit a particular control signal in response to the pressing of a push-button for a particular predetermined period of time even after the operator physically releases the push-button. This may be especially appropriate where the advantage of allowing the operator to cause a function to occur for a long period of time without the inconvenience of holding down the push-button during that entire time outweighs the loss of fine control of the output element by the operator. Such a time-delay switch may be appropriate with respect to PTO on push-button 420*a*, since the operator may wish to cause PTO shaft 116 to rotate continuously for a period of time even though the operator does not continue to press the push-button.

In addition to push-buttons 410–430, fob 400 for tractor 100 also contains an "emergency stop" push-button 440. Upon the operator's pressing emergency stop push-button 440, fob 400 returns to a specific default state or performs a specific default function. In one embodiment, fob 400 is designed such that, upon emergency stop push-button 440 being pressed by the operator, the fob transmits a signal (or ceases to transmit a signal) such that all movement of hitch 151 ceases. In a second embodiment, fob 400 transmits signals so that, along with causing movement of hitch 151 to cease, each of auxiliary valves 119 enters the neutral state (so that hydraulic fluid flow ceases) and PTO shaft 116 ceases moving.

Emergency stop push-button 440 provides an operator with a quick and easy way of stopping activity in the event that one or more of the output elements are operating in an unintended manner or having unexpected consequences. This is particularly appropriate for configurations in which the push-buttons operate as time-delay switches. For example, the operator may cause hitch 151 to begin lowering and then recognize that, if the hitch continues to lower, it will damage crops in a field. If hitch-down push-button 410*b* is a time-delay switch (and hitch-up push-button 410*a* is not configured such that pressing it will immediately override an earlier pressing of push-button 410*b*), the operator will not be able to cause hitch 151 to stop lowering immediately by pressing or releasing the hitch-down push-button, but will be able to stop the lowering of the hitch by pressing emergency stop push-button 440.

While the embodiment of fob 400 in FIG. 4 shows an individual emergency stop push-button, in another embodiment, no specific emergency stop push-button would be provided. Instead, the fob would provide emergency stop functionality with respect to the operation of hitch 151 (e.g., immediately stop the raising or lowering of the hitch) if the operator pressed both hitch-up and hitch-down push-buttons 410*a* and 410*b* simultaneously. Similar emergency stop functionality could be provided with respect to the operation of the other output elements (e.g., auxiliary valves 119 and PTO shaft 116).

Along with the features described above, fob 400 may further incorporate features that provide greater convenience to the operator. As shown, fob 400 may have a location light 450 that facilitates finding of the fob by the operator when the fob has been misplaced. Such a location light may turn on automatically when fob 400 has both been away from its holder (as described above) for a predetermined period of time and has not experienced a command input (at one of push-buttons 410–430) for a given period of time. Alternatively, fob 400 may be capable of receiving a search signal from cab 120 of tractor 100. Such a search signal would be activated by the operator once the operator realized that fob 400 had been misplaced and, upon receiving the search signal, the fob would activate location light 450. Alternatively, fob 400 may include, instead of (or in addition to) location light 450, a warning beeper or buzzer that may alert an operator to the fob's presence. The warning beeper or buzzer would sound under the same circumstances as location light 450 would turn on as described above.

Further, fob 400 may transmit signals that are coded for use in connection with a specific tractor 100. That is, fob 400 and tractor 100 are configured so that only that tractor (more specifically, the output elements on the tractor) is responsive to signals transmitted from that fob. Alternatively, however, fob 400 and several work vehicles may be configured so that the one fob may be used to control each of the several work vehicles. Alternatively, several fobs and a particular work vehicle may be configured so that any one of the fobs may be used to control that work vehicle. In this embodiment, the work vehicle is configured so that the work vehicle (more specifically, the output elements on that work vehicle) only responds to one fob at any given time. Such an embodiment may be easily implemented if each fob still has a distinctive code for its transmitted signals and if the work vehicle is capable of distinguishing between the fobs based on these codes. Further, the work vehicle can require that a time delay occur following the last signal received from a fob before the work vehicle responds to a signal from a different fob. Such a time delay may be set sufficiently long such that an operator monitoring the operation of the work vehicle is able to detect that the work vehicle has switched from operating in response to signals from one fob to operating in response to signals from a different fob. In another embodiment, the code of a fob repeatedly changes to prevent breaches of security. In this embodiment, the fob and the receiver (described with respect to FIG. 5) are designed to transmit signals under and to recognize a new "rolling code" following each successive transmission.

Fob 400 transmits control signals to tractor 100 for reception by a receiver 500, as shown in FIG. 5. Receiver 500 is primarily designed to receive wireless remote control signals transmitted by fob 400 and then to provide, in response to the received signals, control signals to appropriate elements within tractor 100 for controlling the output elements. Receiver 500 may be located at any position on tractor 100 at which the receiver is capable of receiving the control signals transmitted by fob 400 and, in turn, sending related signals to other appropriate tractor elements. Receiver 500 can be located in or near cab 120 of tractor 100 (as in FIG. 6). Although preferably tractor 100 includes only one receiver 500 for receiving signals from fob 400 associated with that tractor, the tractor may include more than one receiver so that different receivers may receive signals from different fobs or receive only signals concerning particular output elements.

Receiver 500 may be of any design capable of receiving wireless signals transmitted by a fob such as fob 400 and then providing, in response to the received signals, related signals to appropriate elements within tractor 100 for controlling the output elements. When the fob has the characteristics of fob 400 as specified above, receiver 500 may have an AM Superheterodyne tuner (e.g., an AM Superregenerative tuner) for receiving signals transmitted at a frequency of approximately 319 MHz (315 MHz) and a tuning range of +/−0.8 MHz. Also, receiver 500 may have a near vertically polarized monopole (internal trace) antenna 505 (see FIG. 5) and have a frequency response of 50 KHz, a sensitivity of −90 dBM (nom), a 5 KHz data rate and a range of greater than 10 meters. Receiver 500 may have reduced RF sensitivity for desired coverage. With respect to power consumption, receiver 500 may have a power consumption at maximum load of +12VDC/22A(peak), 15A (con).

Referring to FIG. 5, receiver 500 includes a number of discrete electrical components. In addition to antenna 505 (e.g., an internal trace antenna), receiver 500 has a microprocessor 510 such as a microprocessor in the 68HC05P family for processing and analyzing the signals received via antenna 505. Microprocessor 510 determines whether a received signal is being transmitted from a recognizable (and authorized) fob, the output element to which the received signal pertains, and whether to provide a related signal for controlling an output element in response to the received signal. Microprocessor 510 is coupled to a timer 515 and a memory element 520. Timer 515 provides timing signals which allow microprocessor 510 to determine, e.g., whether a predetermined time has elapsed since fob 400 last transmitted a wireless control signal (suggesting that the fob may be lost). Memory element 520 may be any one of a variety of memory devices (e.g., EEPROM) and provide a variety of data to microprocessor 510 including, for example, data concerning the identification of fobs.

Receiver 500 communicates with other devices of tractor 100 by way of a variety of input and output terminals or ports 530–535. In addition to having terminals for connection to ground (terminal 530), to a power supply (terminal 531) and to allow programming of the microprocessor (terminal 532), receiver 500 also has specific output terminals 533–535 for providing signals (the "related signals") that, indirectly or directly, control operation of the output elements of tractor 100. In alternative embodiments, receiver 500 may have additional inputs, such as an input for receiving a signal from seat switch 635 or another device for sensing an operator's presence (see FIG. 6).

In one embodiment, microprocessor 510 controls contacts (shown as contacts 543–545) at output terminals 533–535 for each function of the controlled output elements (e.g., a hitch-up output terminal 533, a hitchdown output terminal 534, etc.) in response to signals received by receiver 500 from fob 400. As shown, "other" terminal 535 is representative of the remaining output terminals directed to other output elements. Whenever a particular push-button on fob 400 is pressed (e.g., hitch-up push-button 410*a*), microprocessor 510 causes a contact (e.g., hitch-up contact 543) at the respective output terminal (e.g., hitch-up output terminal 533) to become short-circuited and thereby causes a signal to be provided for control of the related output element (e.g., hitch 151). The contact remains short-circuited as long as the push-button remains pressed (assuming a "dead-man" type push-button, as described above). In one embodiment, "shorting" of a contact means connection, on one side, to a +12 volt power supply and, on another side, to an electro-hydraulic controller such as a solenoid.

Although fobs and receivers may be designed (e.g., by using omnidirectional antennas) to allow communication between the devices regardless of the relative spatial orientation of the devices (other than the absolute distance between the devices), the present invention envisions a system in which control of output elements by way of a fob is only possible when the fob is positioned within a particular spatial region or zone relative to the receiver (or relative to the work vehicle supporting the receiver). The particular spatial region (for the position of the fob relative to the receiver or the work vehicle) within which control is allowed may vary depending upon the type of work vehicle, the devices that are controlled on the work vehicle and the needs of the work vehicle operator, among other criteria.

Figure 6:
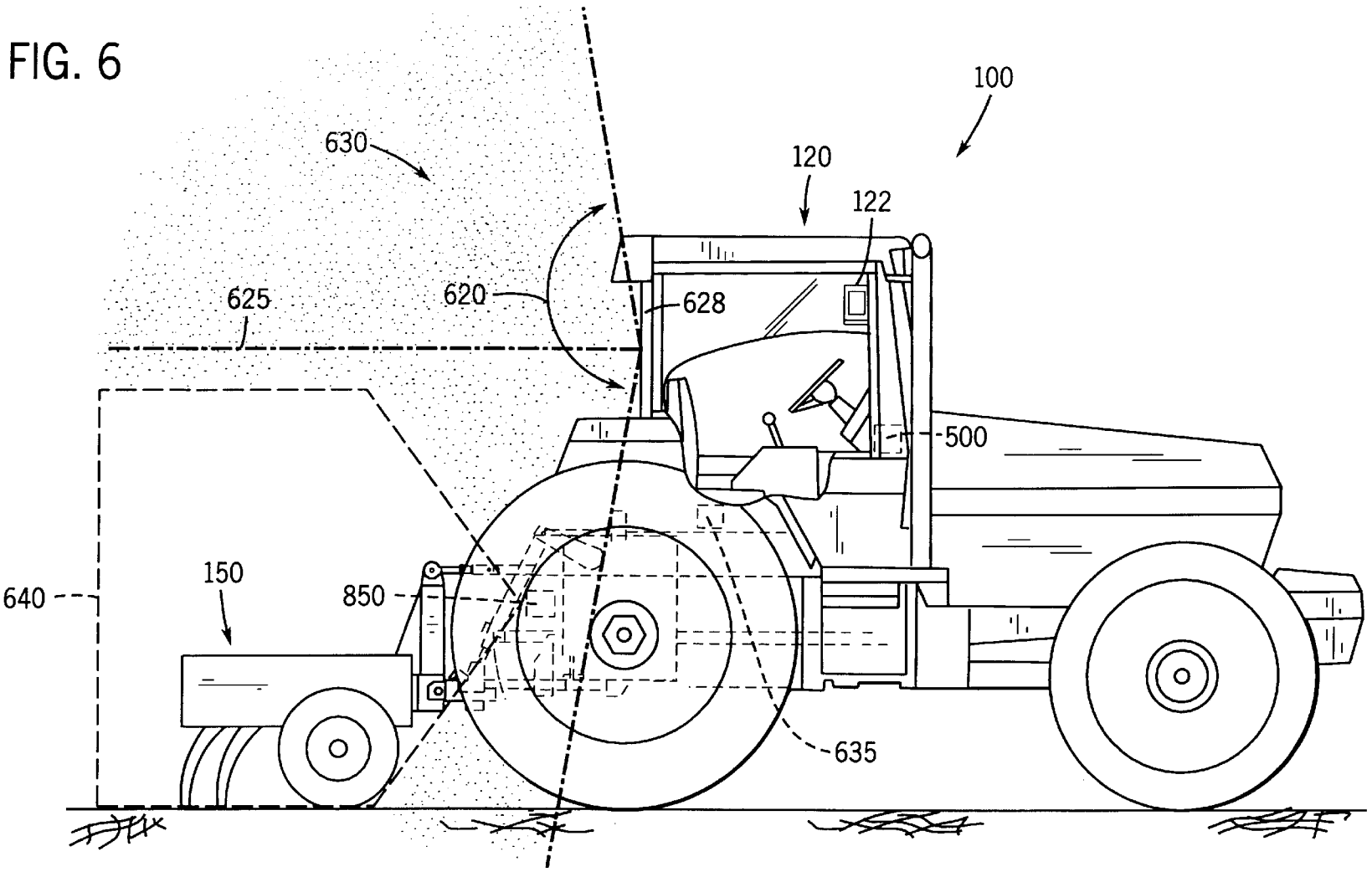
FIG. 6 is a side elevational view of the agricultural work vehicle and implement of FIG. 1 that also shows a modified cone region from within which control via the fob of FIG. 4 is possible.
Figure 7:
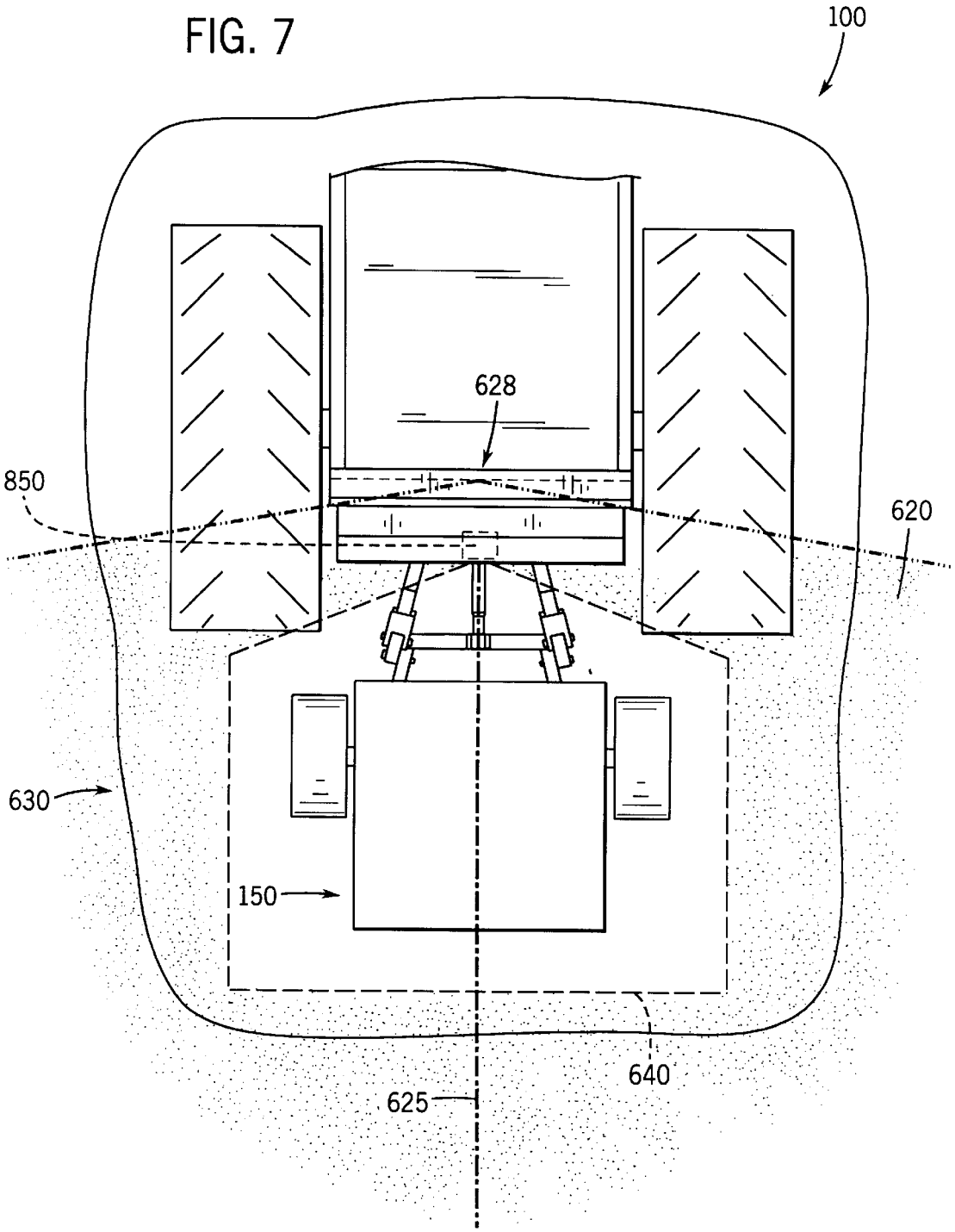
FIG. 7 is a top plan view of the agricultural work vehicle (shown in cut-away) and implement of FIGS. 1 and 6 that also shows the modified cone region of FIG. 6.

Referring to FIGS. 6–7, in one embodiment with respect to tractor 100, fob 400 and receiver 500 (and possibly other elements of the tractor) are designed such that control of the output elements of the tractor using the fob is only possible when the fob is located within (and transmitting control signals from within) a cone 620 extending rearward from the tractor. (FIG. 6 provides an elevation view of cone 620 from the side of tractor 100, while FIG. 7 provides a plan view of cone 620 from the top of the tractor.) Cone 620 is defined to encompass the set of points located a predetermined number (e.g., 80) degrees off of a line 625 extending rearward from and perpendicular to a rear window 628 of cab 120. Cone 620 includes primarily those positions from which an operator holding fob 400 could personally observe the operation of hitch 151, PTO shaft 116, and auxiliary valves 119 (or devices coupled to the auxiliary valves) in response to commands from the fob. That is, an operator located at positions in front of and outside of cone 620 would tend to have an obstructed view of the operation of the controlled output elements of tractor 100.

Also, in this embodiment, it is desirable (for reasons discussed above) to preclude control of output elements by fob 400 when the fob (or the operator holding the fob) is located within cone 620 at a location near to the output elements, particularly, near hitch 151 (i.e., within region 640). Thus, the specified spatial region is a modified cone 630 (which in FIGS. 6 and 7 is shown as the stippled portion of cone 620). Preventing control when fob 400 is near the output elements is made possible, in one embodiment, by way of a position sensor 850, described below with respect to FIG. 8. In a similar embodiment, it may be desirable to allow control only when the operator is to the right or left sides of PTO shaft 116.

In alternate embodiments relating to tractors having other controlled output elements, or relating to other work vehicles such as combine 200 (or where vehicle operators have different needs), fob 400 and receiver 500 (and other elements as well) may be designed so that fob 400 may be located within other particular spatial regions (instead of, or in addition to, modified cone 630) and still control the output elements. For example, it may be desirable if fob 400 may be used to control output elements when located within different-sized cones or differently-shaped regions with respect to the work vehicle. Alternatively, it may be desirable for an operator (again with respect to tractor 100) to be able to control output elements both when outside cab 120 within modified cone 630 and when inside the cab. (The operator may be able to view the response of output elements to input commands at fob 400 from within cab 120 by looking through rear window 628 of the cab.) Allowing for control capabilities via fob 400 from within cab 120 may allow the fob to replace certain input elements within the cab (for example, certain options displayed on touch screen 122 may no longer need to be displayed). Alternatively, allowing for control via fob 400 from within cab 120 may simply provide the operator with a secondary, and possibly more convenient, set of controls for controlling output elements.

If control using fob 400 both from within cab 120 and outside of the cab is desired, it may further be desirable to limit the receptiveness of receiver 500 so that at any given time the receiver only receives signals transmitted from within one or the other of these regions. Preferably, the region of receptiveness would be that region in which the operator is located. For example, if the operator of tractor 100 is seated within cab 120, it may be undesirable that receiver 500 remain receptive to spurious signals from outside the cab since responsiveness to such signals undermines the operator's control of the tractor. Restricting the receptiveness of receiver 500 to signals emanating from a specific region depending upon where the operator of the work vehicle is located can be achieved by use of an operator position sensor such as a seat switch 635 located within cab 120. So long as the operator is seated within cab 120, seat switch 635 senses the operator's presence and sends a signal to receiver 500 causing the receiver to process only signals from fob 400 that are emanating from within the cab. However, if the operator leaves cab 120 and remains away for a predetermined period of time (e.g., 5–7 seconds), seat switch 635 signals the operator's absence and receiver 500 (upon determining passage of the predetermined period of time) switches to being receptive only to signals from fob 400 emanating from outside of the cab (e.g., from within modified cone 630). In alternative embodiments, an operator position sensor other than seat switch 635 may be employed. (Further, in alternative embodiments, the regions from which fob 400 may be used to control output elements may be selected by the operator at one or more input devices in cab 120 or elsewhere.)

However, in alternative embodiments, it may be desirable to allow control of output elements by way of fob 400 from outside of cab 120 even when an operator is within the cab. This may be the case if a second person (other than the operator) is outside cab 120 and it is desired that the second person be able to control the output elements, for example, because the second person has a better view of the output elements. In this situation, it may be desirable to allow for selection by the operator of whether fob 400 may control output elements from within cab 120 or from outside the cab (or may control output elements from both regions or not at all). Such selections may be input by an operator at a separate switch within cab 120, by way of fob 400 (which would have additional push-buttons for making such selections) when the fob is in a particular location, or by any one of a variety of other input devices.

In another embodiment (not shown), an analog of fob 400 is employed in conjunction with combine 200. In this embodiment, control of header 225 of combine 200 by way of fob 400 is allowed only when the fob is within a particular spatial region in front of the combine. This spatial region may be similar to that described above with respect to tractor 100, e.g., a cone extending from the front of combine 200 and defined as encompassing the set of points that are located a given number (e.g., 80) of degrees off of a line extending forward from and perpendicular to a front window of cab 220 of the combine. This spatial region would be defined to include primarily those positions from which an operator holding the fob could personally, visually observe the operation of header 225 in response to commands from the fob.

Configuring a fob, receiver, and other elements of a work vehicle so that output elements of the vehicle are only controlled by the fob when the fob is within particular spatial regions may be accomplished in several ways. First, the receiver's antenna may be configured so that the receiver only receives signals emanating from a fob that is located within the particular spatial region of interest. Consequently, communication between the fob and the receiver is only possible at, and control of output elements based upon control signals from the fob is thereby restricted to, times when the fob is located within the particular spatial region. For example, rather than having an omnidirectional antenna, the receiver may have (as specified above with respect to receiver 500) a near vertically polarized monopole antenna with a field pattern that effectively limits the reception of signals by the receiver to signals that are incoming toward the antenna from one side of the antenna. In alternative embodiments, another type of antenna may be used, or multiple antennas may be used.

Also, secondary sensors (or other wireless electronics) may be used to supplement the operation of the fob and the receiver. For example, a standard position sensor may be used to determine the position of the work vehicle relative to other objects located around the work vehicle. Also, the fob may be configured to emit an additional signal (that is, in addition to the control signals emitted by the fob) that is capable of being sensed by the receiver or by an additional sensor. Based on the strength of this received signal, it may be determined whether the fob is located within a desirable proximity of the work vehicle (if so, the receiver is activated to respond to the control signals of the fob).

In one embodiment with respect to tractor 100, two of the above methods are employed for restricting the control of output elements by way of fob 400 to times at which the fob is located within modified cone 630 (described above). This embodiment is presented in FIG. 8, which shows the interrelationship between various elements that together form control system 800 of tractor 100. As shown, control system 800 includes receiver 500, which in the preferred embodiment is designed to receive signals from fob 400 only when the fob is located within cone 620 (once again, the reception is limited through the use of a particular type of antenna or antennas). Receiver 500 is connected to control unit 810, which is representative of any of the control units described above.

In this embodiment, upon receiving signals from fob 400, receiver 500 sends related signals to control unit 810. These related signals are interpreted and processed by control unit 810 before the control unit transmits further control signals to controlled output element 830 (which represents any of the output elements described above). Such interpretation and processing by control unit 810 may take a variety of forms, including amplification (e.g., so that a high-power device such as a solenoid within a controlled output element may respond to the low-power signals from receiver 500). As described above with respect to FIG. 3, control unit 810 is microprocessor-based and connected to a databus 820, from which the control unit may obtain various additional information (e.g., from other control units). (In alternative embodiments, control unit 810 need not be connected to a databus, but instead may be hardwired to other elements.) Additionally, control unit 810 may be coupled to other inputs 840 (representative of a variety of input devices, e.g., armrest control console 121 or touch screen 122) from which it may receive control instructions or other information (typically provided by the operator). Consequently, control unit 810 also may operate to override or modify the related signals it receives from receiver 500 in response to this other information.

Referring to FIG. 8, control system 800 may also include a position warning sensor 850 such as the Guardian Sensor portion of the Guardian Sensor System manufactured by Sense Technologies of Grant Island, Nebraska. This system includes both a sensor and a warning unit. The warning unit is normally mounted within the cab of a vehicle, where it provides light and sound signals to the vehicle operator in response to signals from the sensor. Sensor 850, mounted at the rear of tractor 100 (FIGS. 6 and 7), can sense (using a microwave radar) whether any object within a predetermined range (e.g., 12 feet) is approaching the sensor. Therefore, sensor 850 can determine whether an operator (presumably holding fob 400) is moving in relation to (e.g., towards) the rear of tractor 100 from within a limited (and substantially cubic) region directly behind the tractor.

In one embodiment, sensor 850 is directly connected to control unit 810 and provides a signal to the control unit when the sensor senses an operator who is presumably holding fob 400 (or senses another object) within its sensing range. If control unit 810 receives such a signal from sensor 850, it overrides any control signals received from receiver 500 and thereby prevents further control of output element 830 by way of fob 400. Consequently, the combined effect of receiver 500 (with its restricted reception characteristic), sensor 850, and control unit 810 is to restrict control of output element 830 by way of fob 400 to times at which the fob is located within modified cone 630. In other words, control of output element 830 by way of fob 400 is only possible when the fob is within cone 620, but control is also precluded when an operator or other object is particularly close to the output element 830 itself.

In an alternate embodiment, sensor 850 may, instead of being coupled to control unit 810, be coupled to receiver 500 (as shown by the dashed line in FIG. 8). Receiver 500 would, in that embodiment, be programmed to cease sending related signals to control unit 810 (even though the receiver continued to receive signals from fob 400) when it received signals from sensor 850 indicating an operator (or other object) to be present within its sensing range. Therefore, this alternate embodiment of control system 800 would have the same overall effect of only allowing control of output element 830 by way of fob 400 when the fob is within modified cone 630. (In a further alternative embodiment, sensor 850 would be an internal component of receiver 500.)

FIG. 9 shows an additional alternate embodiment of control system 800 (labeled control system 900 in FIG. 9) of tractor 100. In contrast to the embodiments of FIG. 8, this embodiment lacks separate control units for controlling output element 830. Instead, receiver 500 and output element 830 are designed such that receiver 500 is capable of exercising direct control over the output element without an intermediate device. To the extent that output element 830 includes a high-power device, receiver 500 may require (in addition to those elements described with reference to FIG. 3), a power converter so that the receiver may provide high-power related signals to the output element. As shown, sensor 850 is coupled to receiver 500. In order to restrict control of output element 830 by way of fob 400 to times at which fob 400 is within modified cone 630, receiver 500 (as with respect to FIG. 8) is designed (a) to receive signals from the fob only when the fob is within cone 620, and (b) to cease sending related signals to output element 830 if sensor 850 indicates that an operator (or other object) is within its sensing range. (In a further alternative embodiment, sensor 850 would be an internal component of receiver 500.)

Although only a few exemplary embodiments of this invention have been described above, those skilled in the art will appreciate that many modifications are possible in the exemplary embodiments without materially departing from the novel teachings and advantages of this invention. While the above discussion regarding FIGS. 4–9 has principally focused on embodiments of tractor 100, it should be readily appreciated that these embodiments are exemplary and can be readily modified for use in a variety of work vehicles, such as combine 200. Further, the invention may employ a variety of different types of transmitters (fobs), receivers, sensors or control units for communicating instructions from the operator and determining whether such communicated instructions should influence the operation of the work vehicle. Also, the invention may, depending upon the work vehicle, the needs of the operator of the work vehicle and the controlled elements on the work vehicle, be designed to restrict control via the fob to times at which the fob is in a variety of positions (e.g., positions other than within the modified cones, and vehicle cab as described above). Accordingly, all such modifications are intended to be included within the scope of the invention as defined in the claims. Other substitutions, modifications, changes and omissions may be made in the design, operating conditions and arrangement of preferred and alternative embodiments without departing from the spirit of the invention as expressed in the appended claims.

What is claimed is:

1. An apparatus for wireless remote control of an output element coupled to a work vehicle, the output element configured to perform work external to the work vehicle and to be actuated by an actuator controlled by an output controller in response to at least a remote control signal, the apparatus comprising:

a wireless remote transmitter movable with respect to the work vehicle and including an actuatable input device for generating a command signal, a transmitter antenna, and a transmitter control circuit coupled to the input device and the transmitter antenna, the transmitter control circuit configured to receive the command signal from the input device, to generate the remote control signal in response to the command signal, and to apply the remote control signal to the transmitter antenna for wireless transmission to the vehicle; and a wireless receiver supported by the work vehicle and including a receiver antenna and a receiver control circuit coupled to the receiver antenna and the output controller, the receiver control circuit configured to receive the remote control signal from the receiver antenna after transmission by the wireless remote transmitter, and to apply the remote control signal to the output controller, wherein the output element is responsive to actuations of the input device.

2. The apparatus of claim 1, wherein the output element is responsive to actuations of the input device only if the wireless remote transmitter is transmitting the remote control signal from within a first particular spatial region relative to the vehicle.

3. The apparatus of claim 2, wherein the wireless remote transmitter comprises a beacon for facilitating location of the wireless remote transmitter.

4. The apparatus of claim 3, wherein the beacon includes a buzzer.

5. The apparatus of claim 2, wherein the work vehicle is a construction work vehicle.

6. The apparatus of claim 2, wherein the wireless remote transmitter is coded for use only with the work vehicle.

7. The apparatus of claim 2, wherein the wireless remote transmitter is coded for use with the work vehicle and with a second vehicle.

8. The apparatus of claim 2, wherein the work vehicle is capable of receiving the remote control signal from the wireless remote transmitter and a second remote control signal from a second wireless remote transmitter.

9. The apparatus of claim 8, wherein the work vehicle can only receive the remote control signal if a predetermined time delay has passed since the work vehicle received the second remote control signal.

10. The apparatus of claim 2, wherein the actuatable input device is a deadman-type switch.

11. The apparatus of claim 2, wherein the actuatable input device is a time delay switch.

12. The apparatus of claim 2, wherein the actuatable input device is an emergency stop push-button and the output element ceases moving in response to actuation of the emergency stop push-button.

13. The apparatus of claim 2, wherein the actuatable input device includes two push buttons and the output element ceases moving in response to both of the push buttons being pressed substantially simultaneously.

14. The apparatus of claim 2, wherein the work vehicle is an agricultural work vehicle.

15. The apparatus of claim 14, wherein the agricultural work vehicle is a combine.

16. The apparatus of claim 15, wherein the output element is a header.

17. The apparatus of claim 16, wherein the first particular spatial region comprises a cone extending frontward from the combine.

18. The apparatus of claim 15, wherein the output element is a conveyor for moving harvested crop.

19. The apparatus of claim 14, wherein the agricultural work vehicle is a tractor.

20. The apparatus of claim 19, wherein the output element is a hitch.

21. The apparatus of claim 20, wherein the first particular spatial region comprises a cone extending rearward from the tractor.

22. The apparatus of claim 21, wherein the receiver antenna is configured so the wireless receiver is only capable of receiving the remote control signal when the wireless remote transmitter is within the cone.

23. The apparatus of claim 19, wherein the output element is an auxiliary valve.

24. The apparatus of claim 19, wherein the output element is a PTO shaft.

25. The apparatus of claim 24, wherein the first particular spatial region comprises regions on either side of the PTO shaft.

26. The apparatus of claim 1, wherein the first particular spatial region comprises a cab interior of the work vehicle.

27. The apparatus of claim 1, further comprising a proximity sensor supported by the work vehicle, the proximity sensor being capable of sensing whether a physical entity is within a second particular spatial region relative to the proximity sensor.

28. The apparatus of claim 27, wherein the first particular spatial region comprises a modified cone extending rearward from the work vehicle, the modified cone excluding the second particular spatial region if the proximity sensor senses that the physical entity is within the second particular spatial region.

29. A method of wireless remote control of an output element coupled to a work vehicle, the output element configured to perform work external to the work vehicle and to be actuated by an actuator controlled by an output controller in response to at least a remote control signal, the method comprising the steps of:

locating a wireless remote transmitter, which is movable with respect to the work vehicle, within a particular spatial region relative to the work vehicle;

providing, by way of an actuatable input device, a command signal to a transmitter control circuit of the wireless remote transmitter;

generating a remote control signal at the transmitter control circuit in response to the command signal;

sending the remote control signal, by way of a transmitter antenna, to a wireless receiver supported by the work vehicle;

receiving the remote control signal, by way of a receiver antenna, at a receiver control circuit of the wireless receiver; and applying the remote control signal to the output controller, wherein the output element is responsive to actuations of the input device.

30. The method of claim 29, wherein the output element is responsive to the command signal only while the wireless remote transmitter is transmitting the remote control signal from within the particular spatial region relative to the work vehicle.

31. The method of claim 30, further comprising the step of:

sensing a condition by way of a proximity sensor also supported by the work vehicle, wherein the condition is whether a physical entity is within a second particular spatial region relative to the work vehicle and wherein the output element is responsive to the command signal only if the condition is not sensed.

32. An apparatus for wireless remote control of an output element coupled to a work vehicle, the output element configured to perform work external to the work vehicle and to be controlled in response to at least a remote control signal, the apparatus comprising:

a remote transmitter means for receiving an input command and for wirelessly sending the remote control signal in response to the input command; and a receiver means supported by the work vehicle for receiving the remote control signal and for providing, in response to the control signal, a related signal to a system element in the work vehicle, the related signal being used to control the output element.

33. The apparatus of claim 32, wherein the output element is only responsive to the input command if the remote transmitter means is sending the control signal from within a particular spatial region relative to the work vehicle.

* * * * *